United States Patent [19]

Becker et al.

[11] 4,445,318

[45] May 1, 1984

[54] METHOD AND DEVICE FOR MAKING A KNOT-FREE THREAD CONNECTION BY SPLICING

[75] Inventors: Rolf Becker, Mönchen-Gladbach; Josef Bertrams; Franz Grabatsch, both of Wegberg; Gregor Kathke, Viersen; Wolfgang Kiesewetter, Willich; Herbert Knors, Mönchen-Gladbach; Jakob Leven, Wegberg; Erich Quack, Mönchen-Gladbach; Klaus Rautenberg, Erkelenz; Joachim Rohner, Mönchen-Gladbach; Klaus Rosen, Mönchen-Gladbach; Günter Wilms, Mönchen-Gladbach; Heinz Zumfeld, Mönchen-Gladbach, all of Fed. Rep. of Germany

[73] Assignee: W. Schlafhorst & Co., Mönchen-Gladbach, Fed. Rep. of Germany

[21] Appl. No.: 367,118

[22] Filed: Apr. 9, 1982

[30] Foreign Application Priority Data

Apr. 11, 1981 [DE] Fed. Rep. of Germany ..... 3114790

[51] Int. Cl.[3] ..... D01H 15/00

[52] U.S. Cl. ..... 57/22; 57/261

[58] Field of Search ..... 57/22, 23, 261

[56] References Cited

U.S. PATENT DOCUMENTS

| | | | |
|---|---|---|---|
| 3,903,680 | 9/1975 | Isern | 57/22 |
| 4,229,935 | 10/1980 | Wain | 57/22 |
| 4,244,169 | 1/1981 | Ligones et al. | 57/22 |

*Primary Examiner*—Donald Watkins

*Attorney, Agent, or Firm*—Herbert L. Lerner; Laurence A. Greenberg

[57] ABSTRACT

Method of producing a knot-free thread connection by splicing, which includes mixing, alternately interlocking and anchoring individual fibers of the threads to be joined to each other in a first pre-splicing operation, and subsequently further and finally intertwining and anchoring the threads to each other in a separate finish-splicing operation, and an apparatus for carrying out the method.

16 Claims, 7 Drawing Figures

METHOD AND DEVICE FOR MAKING A KNOT-FREE THREAD CONNECTION BY SPLICING

This invention relates to a method and device for making a knot-free thread connection by splicing.

Experience has shown that with the known splicing devices it is not possible to splice all threads satisfactorily. Most of all, strongly twisted and thin threads can only be spliced with great difficulty, or not at all, with the heretofore-known methods and devices.

The invention is based on the recognition that it is necessary to pretreat the threads more intensively before the actual splicing operation, than is done at present. Consequently, it is an object of the invention to provide a method and device for making a knot-free thread connection by splicing, which overcomes the hereinafore-mentioned disadvantages of the heretofore-known methods and devices of this general type, and to produce a good knot-free connection even with strongly twisted, short-fiber threads.

With the foregoing and other objects in view there is provided, in accordance with the invention, a method of producing a knot-free thread connection by splicing, which comprises performing the splicing operation in two steps, namely mixing, alternately interlocking and anchoring fibers of the threads to be joined to each other in a first pre-splicing operation, and subsequently further and finally intertwining and anchoring the threads to each other in a separate special finish-splicing operation.

In accordance with another mode of the invention, there is provided a method which comprises simultaneously or subsequently introducing a twist of the thread in the spliced portion.

In accordance with a further mode of the invention, there is provided a method including two needle supports and a finish-splicing device, wherein the pre-splicing operation comprises introducing the threads to be joined between the two needle supports from opposite sides of the needle supports, subsequently connecting the threads to each other by intermeshing the needle supports to mix the individual fibers, and separating the needle supports, and the finish-splicing operation includes placing the connected threads into the finish-splicing device after separating the needle supports and finally and securely connecting the threads to each other in the finish-splicing device.

In accordance with an added mode of the invention, there is provided a method which comprises combing endings of the threads prior to the presplicing operation.

In accordance with an additional mode of the invention, there is provided a method which comprises combing endings of the threads prior to the pre-splicing operation with the needle supports.

In accordance with again another mode of the invention, there is provided a method including rotatable needle support rollers, which comprises rotating the rollers in the direction toward the thread endings for combing, and intermeshing the rollers during the pre-splicing operation.

In accordance with again a further mode of the invention, there is provided a method which comprises performing the intermeshing step during pre-splicing without rotating the rollers.

In accordance with again an added mode of the invention, there is provided a method which comprises performing the intermeshing step during pre-splicing by rotating the rollers against the direction toward the thread endings and simultaneously moving the rollers closer to each other.

In accordance with the apparatus of the invention, there is provided a device for performing a method of producing a knot-free thread connection by splicing, comprising a pre-splicing device having an outlet side, two needle supports disposed opposite each other, and means for sliding at least one of the needle supports toward the other of the needle supports, and a finish-splicing device disposed at the outlet side of the pre-splicing device.

In accordance with another feature of the invention, the needle supports each have needles disposed in the same position as the other of the needle supports, and the needle supports are disposed offset or opposite relative to each other for allowing the needles of one of the needle supports to be inserted or to dip between the needles of the other of the needle supports.

In accordance with a further feature of the invention, the needle supports are in the form of rollers.

In accordance with an added feature of the invention, the rollers have needles disposed thereon in spiral patterns diverging from the middle of the rollers outward toward the ends of the rollers in a given combing direction of the rollers.

In accordance with an additional feature of the invention, the rollers are hollow and have a perforated shell, and including means for connecting the rollers to a controllable air suction source.

In accordance with a concomitant feature of the invention, there is provided a reversible rotational drive for each of the rollers.

According to the method proposed by the invention, there is always a preparatory splice formed before the actual finish-splicing operation. The results are especially durable splice connections. It is therefore possible to use a specialized device for each of the splicing operations. Each operation can be performed at a special place provided for it. The thread endings, which in some cases have already been prepared by combing, can first be easily connected with each other to a great extent in the pre-splicing device. The connected part of the threads can then be transported along into the adjacent finish-splicing device. The two devices can operate separately from each other as desired, but they can also be combined into a single splicing device in a common machine frame.

In principle, the pre-splicing device can be similar to the finish-splicing apparatus. However, it is advantageous to join the threads which are to be connected by "needling" in the pre-splice device, while for the finish-splicing operation the known compressed air splicing, or electrostatic splicing methods are preferred. It is advantageous to use the same needle supports for combing and "needling" of the thread endings.

Other features which are considered as characteristic for the invention are set forth in the appended claims.

Although the invention is illustrated and described herein as embodied in a method and device for making a knot-free thread connection by splicing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 4:
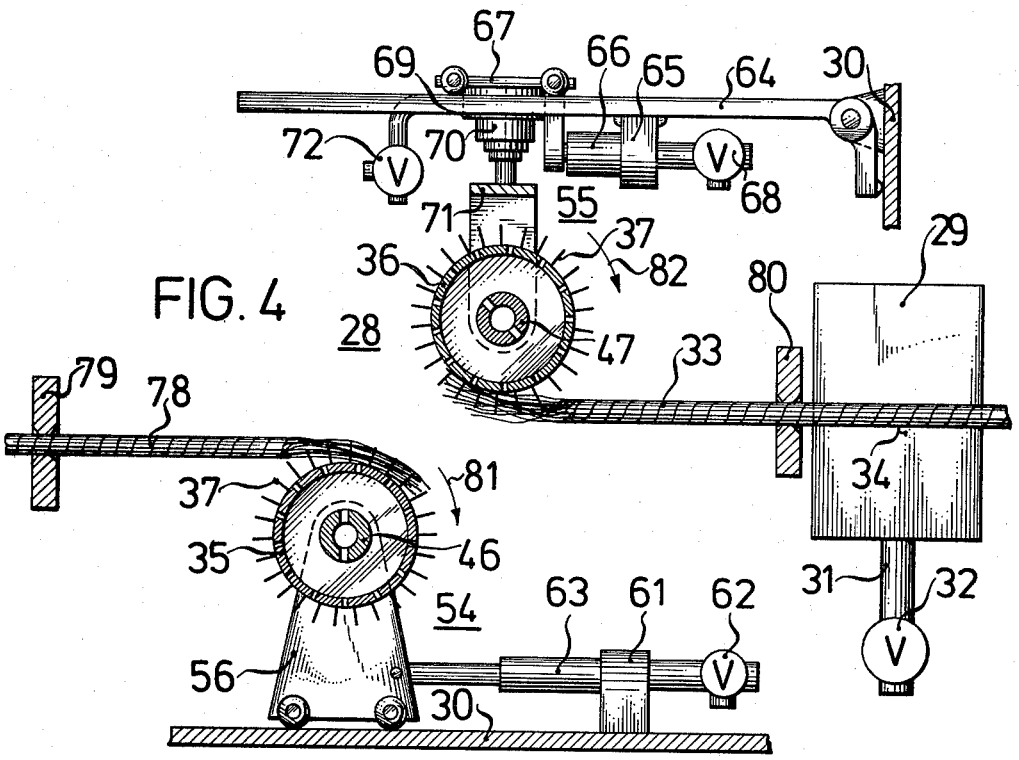
Figure 5:
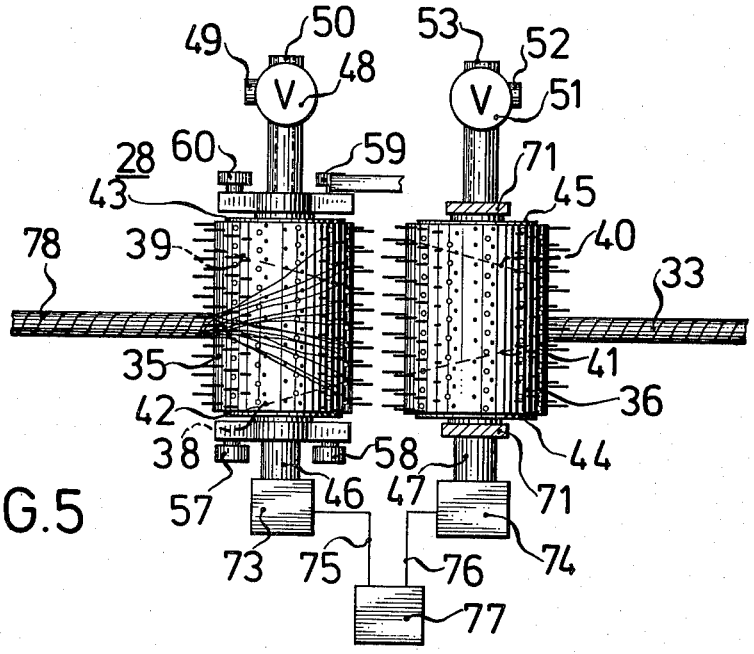
Figure 6:
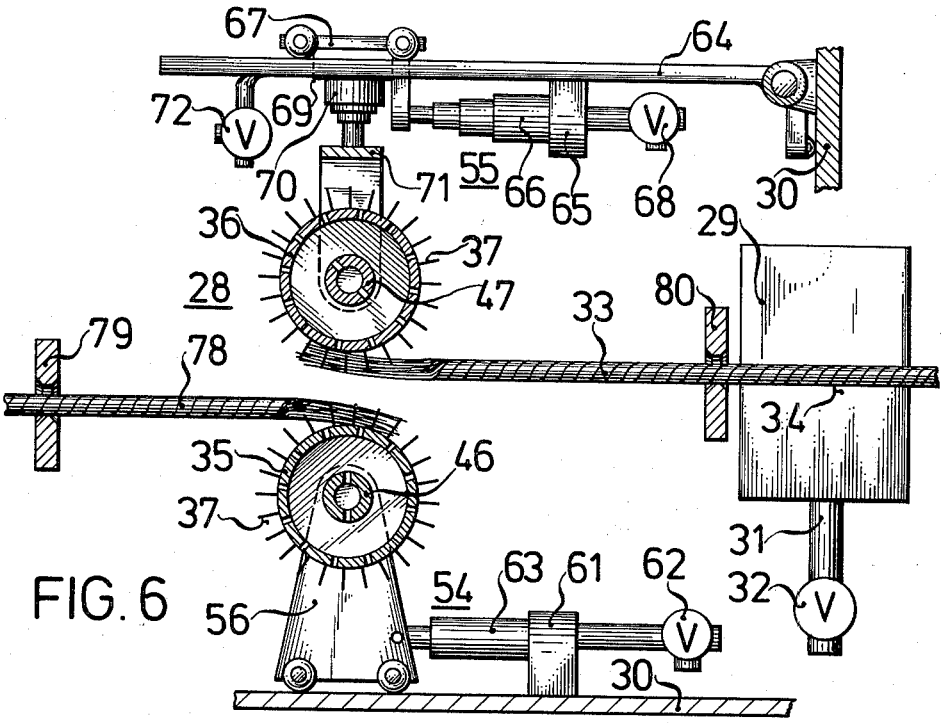
Figure 7:
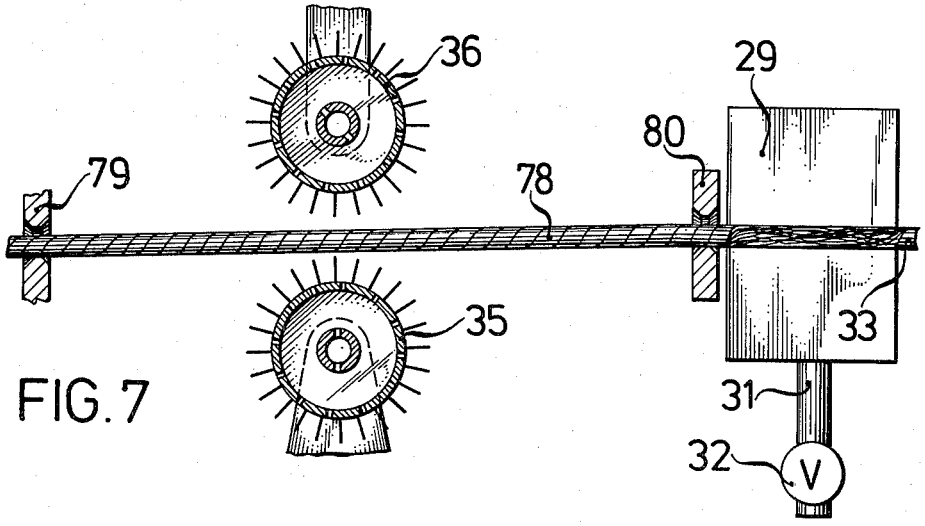

FIGS. 4, 6 and 7 are fragmentary, diagrammatic, side-elevational views of a second embodiment of the invention, FIG. 7 showing somewhat less detail than FIGS. 4 and 6; and FIG. 5 is a diagrammatic and schemtaic top plan view of the embodiment of FIGS. 4, 6 and 7.

Figure 1:
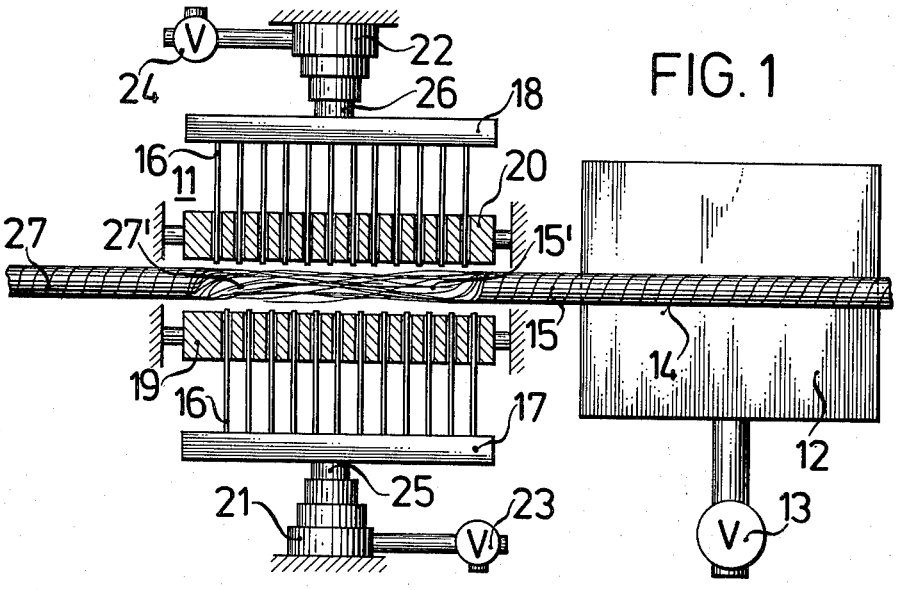
FIGS. 1 and 3 are fragmentary, diagrammatic, front-elevational views of a first embodiment of the invention in two phases of operation.
Figure 3:
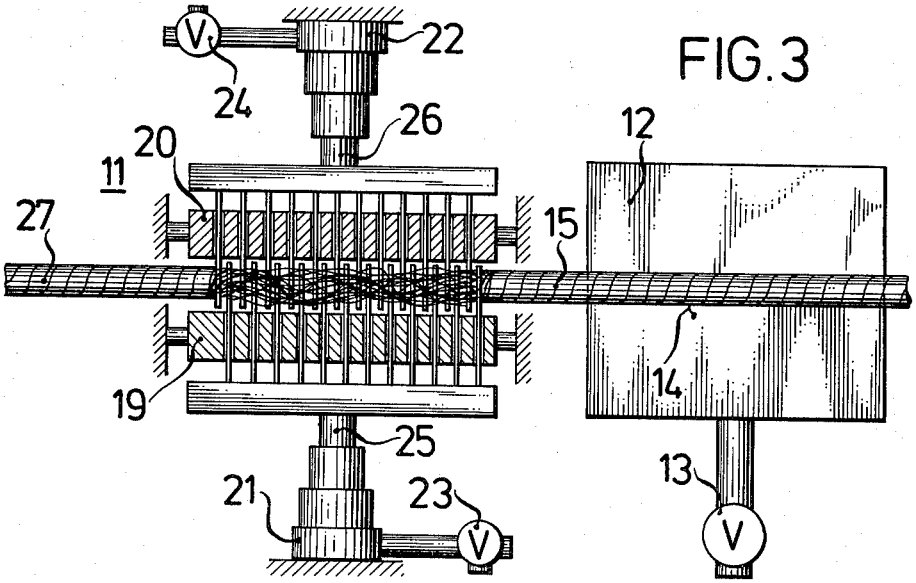

Referring now to the figures of the drawing and first particularly to the first typical embodiment of FIGS. 1 and 3 thereof, there is seen a preparatory splicing device or pre-splicing device 11 and a finish splicing device 12. The finish-splicing device 12 is one of the conventional pressurized air splicing devies which can be supplied with compressed air by a control valve 13. A thread insertion slot 14 serves for inserting a thread into the finish-splicing device 12.

The preparatory splicing device 11 includes two needle supports 17 and 18 which are provided with sets of dull needles 16. The needles of the needle support 17 extend through a stationary hole plate 19, and the needles of the needle support 18 extend through a stationary hole plate 20. The needles are guided by the holes formed in the hole plates.

The needle support 17 is provided with a slide mechanism 21 which acts in the direction toward the other needle support. Likewise, the needle support 18 has a slide mechanism 22 which acts in the direction toward the other needle support. The slide mechanisms work pneumatically. For this purpose, the slide mechanism 21 is provided with a control valve 23, and the slide mechanism 22 similarly has a control valve 24. The slide mechanism 21 is provided with a telescoping tube 25, having an end connected to the needle support 17. The slide mechanism 22 also has a telescoping tube 26, having an end connected to the needle support 18.

The already pre-combed thread end 15' of the thread 15 has been previously positioned between the needles of the pre-splicing device 11, which are still retracted in the hole plates. The thread end 27' of a second thread 27 is also inserted into the pre-splicing device 11, overlapping the first thread 15.

Figure 2:
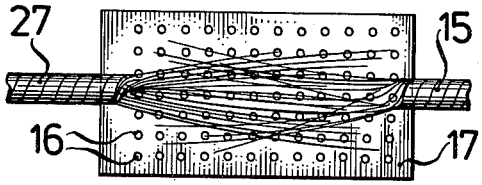
FIG. 2 is a top plan view of a needle support of the embodiment of FIGS. 1 and 3.

FIG. 2 shows the needle support 17 with its needles, as seen from the top. The needles are disposed in the needle support 17 in a certain order. The same arrangement also exists in the needle support 18. The needle support 18 is aligned with respect to the needle support 17 in such a manner that its needles enter the spaces between the needles of the needle support 17 when the two needle supports approach each other.

If the stationary slide mechanisms 21 and 22 are now supplied with compressed air after the thread endings have been inserted into the preparatory splicing device 11, the needles perforate the thread endings which lie on top of each other, and intertwine, bunch and anchor the individual fibers alternatingly with each other, approximately as shown in FIG. 3. If the needles are thereafter retracted again, the two hole plates 19 and 20 prevent the pre-spliced portion from being pulled apart again. As soon as the needles are retracted so that they again lie completely in the hole plates 19 and 20, the threads 15 and 27, now connected with each other, can be moved toward the right, until the pre-spliced portion lies in the finish-splicing device 12. Then the valve 13 is opened, and the pre-spliced threads are finish-spliced by compressed air.

Alternate constructions of this device are also possible. For example, one of the hole plates could also be provided with a slide mechanism, to compress the splice during the splicing operation. However, the two hole plates could also be completely omitted in a simplified construction, and it is also feasible to provide only one needle plate with a slide mechanism, but such impaired embodiments are not shown in the drawings.

In the second embodiment, which is shown in FIGS. 4 and 6 in a diagrammatic side-elevational view with the rollers in cross section, in FIG. 5 in a top plan view, and in FIG. 7 in a diagrammatic side-elevational view, the preparatory splicing device is somewhat more elaborate. The pre-splicing device is designated as a whole with reference symbol 28 in this case. A finish-splicing device 19 is disposed adjacent the preparatory splicing device. Both devices are to be disposed on a common machine frame 30, of which only two part sections are shown in the drawing. The machine frame 30 is in turn a part of a carriage, which can be moved from work station to work station along a winding machine.

The finish-splicing device 29 is connected to a control valve 32 through a pipeline 31. The finish-splicing device 29 is provided with a thread insertion slot 34 for receiving a thread 33. The lower needle support 35 as well as the upper needle support 36 of the pre-splicing device 28 are constructed in the form of rollers. Both rollers 35, 36 carry a great number of similar needles 37, which are disposed in spirals indicated by dot-dash lines, so that, for example, the spirals 38, 39 of the roller 35 and the spirals 40, 41 of the roller 36 diverge from the middle of the rollers in the comb-direction toward both roller ends, as shown in FIG. 5 in a view from the top. Furthermore, the needles are also disposed in rows in their circumferential direction and the rows of the needles of the roller 35 are shifted with respect to the needle rows of the roller 36 in such a manner, that as the rollers approach each other, the needles of one roller can dip into the interspaces between the needles of the other rollers. The rollers are hollow inside and the roller periphery or outer shell is perforated, as especially shown in FIG. 4. At the side faces thereof, the rollers are closed off by plates 42, 43 and 44, 45, respectively. The plates 42, 43 of the roller 35 support a shaft 46, which is drilled open at one end and provided with cross holes, as shown in FIG. 4. In the same way, the plates 44 and 45 of the roller 36 support a shaft 47, which is also drilled open at its end and provided with cross holes, as shown in FIG. 4. The shaft 46 can be connected at its drilled end through a control valve 48 either to an air suction line 49, or to a compressed air line 50, as desired. In the same way, the shaft 47 can be connected at its drilled end through a control valve 51 to an air suction line 52 or to a compressed air line 53, as desired.

The roller or needle support 35 is provided with a slide mechanism which is designated as a whole with reference numeral 54. The slide mechanism 54 includes a carriage 56, which has four wheels 57, 58, 59, 60, and a pneumatic drive motor 61. The air motor 61 is connected to a regulating valve 62, and is supplied by the valve with suction air or compressed air as desired. The drive motor 61 is also provided with a telescoping tube or pipe 63, having an end fastened to the carriage 56.

Similarly, a slide mechanism 55 is mounted on a traverse arm 64 which can be hinged upward. The slide mechanism 55 includes a pneumatic drive motor 65 with a telescoping tube 66, at the end of which a carriage 67 is fastened. The carriage 67 can move back and forth on the traverse arm 64. The pneumatic motor 65 can be supplied by a regulating valve 68 with suction air or compressed air, as desired. The carriage 67 itself carries a pneumatic motor 69 with a telescoping tube 70, at the end of which a support bracket 71 for the shaft 47 of the roller 36, is fastened. The slide mechanism 55 provides the capability of moving the roller 36 in the horizontal direction with the motor 65, and in the vertical direction by means of the motor 69. The motor 69 can be supplied through a regulating valve 72 as desired with suction air or compressed air.

The two rollers 35, 36 can be driven clockwise or counterclockwise. This is effected by reversible rotational drive means, wherein the shaft 46 of the roller 35 is driven by a rotational driver 73, and the shaft 47 of the roller 36 has a rotational drive 74. Both rotational drivers are reversible electric motors which are connected to an electrical control device 77 by means of lines 75, 76, respectively.

At the beginning of the pre-splicing operation, the threads 33 and 78 which are to be spliced are inserted between thread clamps 79, 80, respectively, in such a way that the thread end of the thread 78 coming from the left lies on the roller 35, and the thread end of thread 33 coming from the right lies on the roller 36. In this way, the thread 33 is also already inserted into the thread-insertion slot 34 of the finish-splicing device 29, as shown in FIG. 4. In order to hold the thread endings, for a better loosening of the fibers and for sucking off dirt and short fibers, the control valves 48 and 51 are set so as to be connected to the air suction connections 49 and 52. The rotational drives 73 and 74 are set for clockwise operation, so that the two rollers rotate in the direction of the curved arrows 81, 82, respectively, shown in FIG. 4.

Since the needles on the rollers are disposed in spirals, and diverge toward the outside in the combing direction, the fibers are spread individually and in the shape of a fan by the combing of the thread endings. After the combing and spreading of the thread endings, the two rollers are moved to the position shown in FIG. 6. For this purpose, the thread clamps 79 and 80 are opened first. Then the roller 35 is moved to the right, and the roller 36 is moved toward the left, and thereby lifted simultaneously. The roller drives have already been turned off before the thread clamps are opened.

When the rollers are positioned on top of each other, as shown in FIG. 6, the roller 36 is lowered until its needles dip into the spaces between the needles of the roller 35. Then the two control valves 48 and 51 are set so as to be connected to the compressed air connections 50 and 53. By these measures the thread endings are blown into each other and intertwined with each other. In this way the two rotational drives 73 and 74 cam be shifted simultaneously into reverse to intensify and improve the pre-splicing effect. After the presplicing operation, the roller 36 is raised again, so that finally none of the rollers are any longer in contact with the thread, as shown in FIG. 7.

By blowing compressed air, the thread is now always blown away from the rollers. It is possible at this point to pull the thread, which is already connected by the pre-splicing operation, to the right, until the spliced portion is positioned in the finish-splicing device 29, as shown in FIG. 7. In the finish-splicing device, the final splicing is performed in the conventional manner.

During the finish-splicing or after the finish-splicing, a thread turning or twist is introduced in the spliced portion. This can be accomplished, for example, by holding back a twisting force by means of a non-illustrated thread clamp which would be located to the right of the finish-splicing device according to FIG. 7, this twisting force being released by opening the clamp at the right moment. However, a twisting force can also be created artificially when the thread is inserted, by turning the thread around its longitudinal axis, and then holding it fixed. This can also be done by a thread clamp which is rotatable around the longitudinal axis of the thread.

The invention is not limited to the illustrated and described typical embodiment. Other construction forms are also possible within the scope of the claims.

The foregoing is a description corresponding to German Application No. p 31 14 790.9, dated Apr. 11, 1981, the International priority of which is being claimed for the instant application, and which is hereby made part of this application. Any discrepancies between the foregoing specification and the aforementioned corresponding German application are to be resolved in favor of the latter.

We claim:

1. Method of producing a knot-free thread connection by splicing, which comprises mechanically mixing, alternately interlocking and anchoring individual fibers of the threads to be joined to each other in a first pre-splicing operation, and subequently further and finally intertwining and anchoring the threads to each other in a separate finish-splicing operation.

2. Method according to claim 1, which comprises introducing a twist of the thread in the spliced portion.

3. Method of producing a knot-free thread connection by splicing, including two needle supports and a finish-splicing device, which comprises mixing, alternately interlocking and anchoring individual fibers of the threads to be joined to each other in a first pre-splicing operation, and subsequently further and finally intertwining and anchoring the threads to each other in a separate finish-splicing operation, wherein the pre-splicing operation comprises introducing the threads to be joined between the two needle supports from opposite sides of the needle supports, subsequently connecting the threads to each other by intermeshing the needle supports to mix the individual fibers, and separating the needle supports, and the finish-splicing operation includes placing the connected threads into the finish-splicing device after separating the needle supports and finally and securely connecting the threads to each other in the finish-splicing device.

4. Method according to claim 3, which comprises combing endings of the threads prior to the pre-splicing operation.

5. Method according to claim 3, which comprises combing endings of the threads prior to the pre-splicing operation with the needle supports.

6. Method according to claim 4, including rotatable needle support rollers, which comprises rotating the rollers in the direction toward the thread endings for combing, and intermeshing the rollers during the pre-splicing operation.

7. Method according to claim 6, which comprises performing the intermeshing step during pre-splicing without rotating the rollers.

8. Method according to claim 6, which comprises performing the intermeshing step during pre-splicing by rotating the rollers against the direction toward the thread endings and simultaneously moving the rollers closer to each other.

9. Device for performing a method of producing a knot-free thread connection by splicing, comprising a pre-splicing device having an outlet side, two needle supports disposed opposite each other, and means for sliding at least one of said needle supports toward the other of said needle supports, and a finish-splicing device disposed at said outlet side of said pre-splicing device.

10. Device according to claim 9, wherein said needle supports each have needles disposed in the same position as the other of said needle supports, and said needle supports are disposed offset relative to each other for allowing said needles of one of said needle supports to be inserted between said needles of the other of said needle supports.

11. Device according to claim 9 or 10, wherein said needle supports are in the form of rollers.

12. Device according to claim 11, wherein said rollers have needles disposed thereon in spiral patterns diverging from the middle of said rollers outward toward the ends of said rollers in a given combing direction of said rollers.

13. Device according to claim 11, wherein said rollers are hollow and have a perforated shell, and including means for connecting said rollers to a controllable air suction source.

14. Device according to claim 12, wherein said rollers are hollow and have a perforated shell, and including means for connecting said rollers to a controllable air suction source.

15. Device according to claim 11, including a reversible rotational drive for each of said rollers.

16. Device according to claim 12, including a reversible rotational drive for each of said rollers.

* * * * *